United States Patent [19]

Weddington

[11] Patent Number: 4,702,265

[45] Date of Patent: Oct. 27, 1987

[54] COMBINATION HEATED HAIR AND BEARD COMB

[76] Inventor: Willard T. Weddington, 4123 Roselawn Dr., Indianapolis, Ind. 46226

[21] Appl. No.: 865,373

[22] Filed: May 21, 1986

[51] Int. Cl.[4] ..... A45D 24/10; H05B 1/00

[52] U.S. Cl. ..... 132/118; 132/150; 132/161; 132/11 R; 219/222; 219/227

[58] Field of Search ..... 132/118, 117, 150, 161, 132/11 R, 11 A; 219/222-227

[56] References Cited

U.S. PATENT DOCUMENTS

| | | | |
|---|---|---|---|
| 1,034,859 | 8/1912 | Anderson . | |
| 1,384,906 | 7/1921 | Lee | 132/118 |
| 1,523,461 | 6/1924 | Swan . | |
| 1,536,669 | 3/1923 | Grant . | |
| 1,861,040 | 3/1932 | Williams . | |
| 2,406,490 | 8/1946 | Day | 132/14 |
| 2,528,291 | 10/1950 | Winston | 132/117 |
| 2,545,885 | 8/1948 | Jackson | 132/14 |
| 2,590,447 | 6/1950 | Nord, Jr. et al. | 128/393 |
| 2,598,330 | 12/1949 | Wilson | 132/14 |
| 2,600,472 | 6/1952 | Brock | 132/118 |
| 3,065,759 | 9/1958 | Lewis | 132/118 |
| 3,742,964 | 7/1973 | Newbern | 132/118 |
| 3,760,821 | 9/1973 | Weddington | 132/150 |
| 3,927,684 | 12/1975 | Lam | 219/222 |
| 4,126,143 | 11/1978 | Schroeder | 219/222 |

*Primary Examiner*—Robert P. Swiatek
*Assistant Examiner*—J. Hakomaki
*Attorney, Agent, or Firm*—Woodard, Emhardt, Naughton, Moriarty & McNett

[57] ABSTRACT

A combination heated air and beard comb. A plurality of unheated teeth are alternately positioned between heated teeth. Both types of teeth are cantileveredly mounted to a hollow handle having a pair of electrical wires extending therethrough and through the hollow interiors of the heated teeth to electrically heat the heated teeth. Each heated tooth includes resistance elements therein to transfer the electrical energy into heat energy. A pair of heat shields are mounted to, but spaced apart from, the comb main body creating a heat insulation barrier for gripping purposes. A plurality of slots extend transversely across each unheated tooth allowing a beard to be passed through the slots contacting the heated teeth for grooming purposes.

15 Claims, 4 Drawing Figures

COMBINATION HEATED HAIR AND BEARD COMB

BACKGROUND OF THE INVENTION

This invention is in the field of electrically heated combs. In my U.S. Pat. No. 3,760,821, I disclosed a heated hair comb having a plurality of alternating heated and unheated hair combing teeth mounted cantileveredly to a handle. Electrical resistance means provided in each heated tooth and connectable to a source of electrical energy provide heating of the teeth.

Some of the earlier electrically heated combs are shown in the U.S. Pat. Nos. 1,034,859 issued to G. Anderson, 1,536,669 issued to C. Grant, 2,590,447 issued to S. R. Nord, Jr., et al. The three aforementioned patents disclose combs having electrically heated teeth. Other types of heated combs and hair straightening devices are shown in the following U.S. Pat. Nos.: 1,523,461 issued to J. Swan, 1,861,040 issued to J. E. B. Williams, 2,406,490 issued to D. A. Day, 2,545,885 issued to H. F. Jackson, 2,598,330 issued to E. Wilson, 3,065,759 issued to F. Lewis.

The comb disclosed herein includes two features providing an advantage over the prior act. First, many of the electrically heated combs cause the comb handles to become warm or hot. Therefore, I have designed a pair of heat shields mounted to the handle deflecting heat from the teeth and providing an insulated grip. An additional feature of the comb disclosed herein is incorporation of structure for stroking a beard. The unheated teeth of the comb include a plurality of aligned, transverse slots through which a beard may be guided with the heated elements or teeth being located at the bottom of each slot. Heretofore, such a combination heated hair and beard comb has not been available.

SUMMARY OF THE INVENTION

One embodiment of the present invention is a combination heated hair and beard comb comprising a handle, a plurality of unheated hair combing teeth mounted to the handle and extending lengthwise therefrom in a first direction for combing hair, the teeth including a plurality of slots formed laterally thereon and extending in a second direction for combing a beard, a plurality of heated teeth mounted to the handle and having electrical resistance means therein, and, connecting means on the handle being operable to transfer electrical energy from a source to the electrical resistance means for the heating of the heated teeth.

A further embodiment of the present invention is a heated comb comprising a handle, a plurality of unheated hair combing teeth mounted to the handle and extending lengthwise therefrom in a first direction for combing hair, a plurality of heated teeth mounted to the handle and having electrical resistance means therein, connecting means on the handle being operable to transfer electrical energy from a source to the electrical resistance means for the heating of the heated teeth, and, a pair of heat shields mounted on opposite sides of the handle limiting outwardly flow of heat from the heated teeth through the handle.

Yet another embodiment of the present invention is a heated beard comb comprising a handle, a plurality of unheated combing teeth mounted to the handle and extending lengthwise therefrom in a first direction, the teeth including a plurality of slots formed laterally thereon and extending in a second direction for combing a beard, a plurality of heated teeth mounted to the handle and having electrical resistance means therein, and, connecting means on the handle being operable to transfer electrical energy from a source to the electrical resistance means for the heating of the heated teeth.

It is an object of the present invention to provide a heated beard comb.

A further object of the present invention is to provide a combination heated hair and beard comb.

In addition, it is an object of the present invention to provide a heated comb having heat shields thereon providing an insulated handle.

Related objects and advantages of the present invention will be apparent from the following description.

DESCRIPTION OF THE PREFERRED EMBODIMENTS

Figure 1:
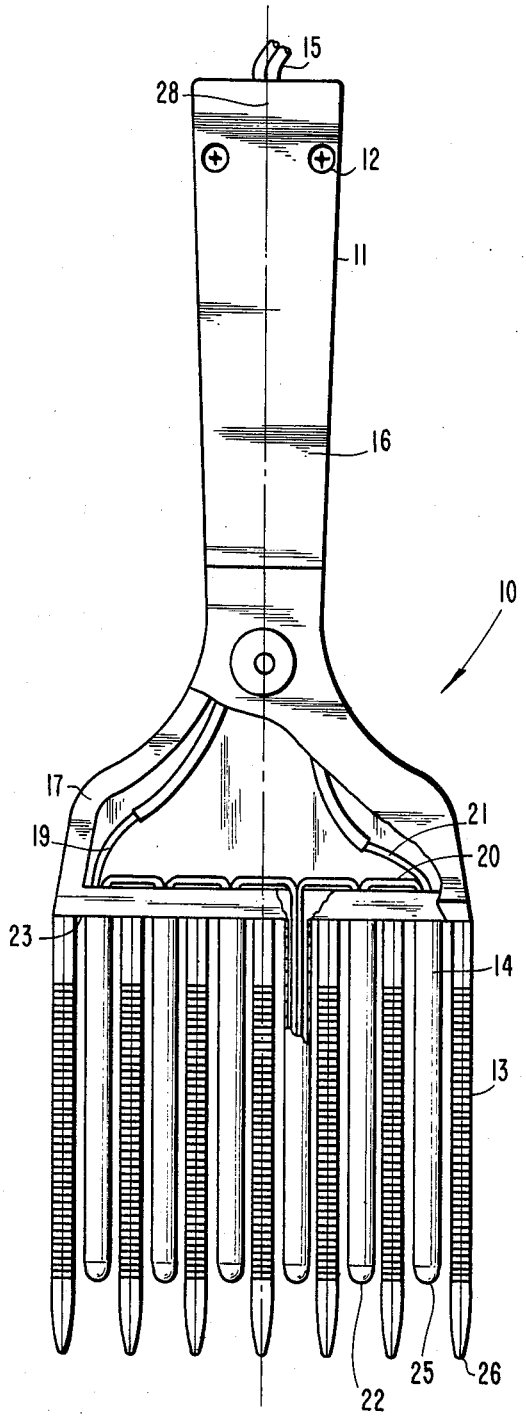
FIG. 1 is a fragmentary view of a comb incorporating the present invention.
Figure 2:
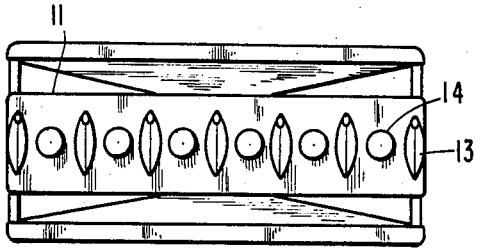
FIG. 2 is an end view of the comb shown in FIG. 1.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a combination heated hair and beard comb 10 having a handle shaped main body 11 and a plurality of unheated hair combing teeth 13 and heated teeth 14 cantileveredly mounted thereto.

Handle or main body 11 is composed of a pair of mating plates 16 and 17 secured together with standard fastening devices 12. Plate 16 is shown fragmented to illustrate the positioning of the means which is operable to transfer electrical energy from a source to the heated teeth. The means includes an electrical cord 15 with a pair of insulated wires connectable to a source of electrical energy. Electrical wire 20 extends into and out of each heated tooth 14 and is joined at either end to the electrical wires within cord 15. Conventional means are utilized to join wire 20 to the wires within cord 15 such as soldering or wrapping the wires together. Wires 19 and 21 which extend out of cord 15 are joined to wire 20 which extends in and out of each end heated tooth and then in and out of the rest of the heated teeth in successive fashion. Heated tooth 22 is shown fragmented to illustrate wire 20 extending into and out of the tooth. Wire 20 is shown as uninsulated for the sake of clarity. In actuality, wire 20 is insulated except when the wire is positioned within each heated tooth. Such an arrangement is identical to that disclosed in my aforementioned U.S. Pat. No. 3,760,821 which is herein incorporated by reference.

The heated teeth 14 are produced from a metal whereas combing teeth 13 are produced from a plastic material. Each heated tooth 14 is cylindrical in configuration and have rounded distal ends 25 recessed from the pointed distal ends 26 of the combing teeth 13. In other words, the length of each heated tooth is sharper than each combing tooth. The combing teeth 13 have a generally elliptical cross-section and are cantileveredly mounted to the handle as shown at location 23. The combing and the heated teeth are arranged in a single row with a tooth at either end of the row being of the combing type of tooth 13. Each hair combing tooth projects outwardly on either side of the single row a distance greater than the heated teeth. As a result, the heated teeth are protected on the sides and at either end of the row as well as the tips of the teeth preventing accidental engagement of the heated teeth with a foreign object.

Figure 3:
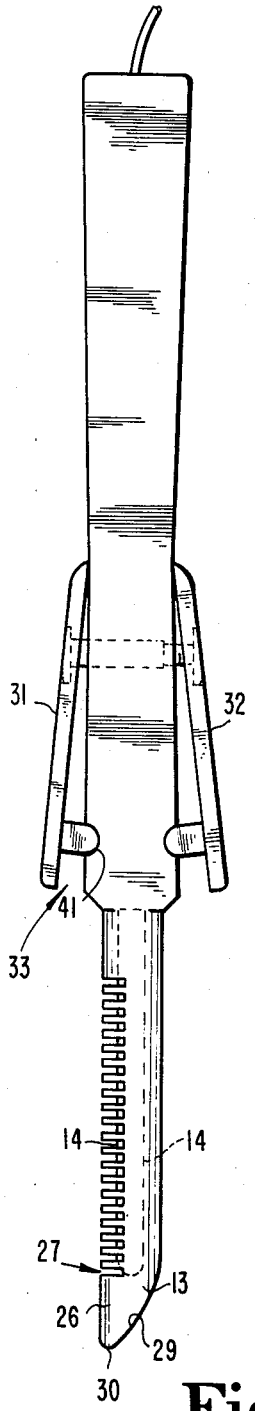
FIG. 3 is a side view of the comb of FIG. 1.
Figure 4:
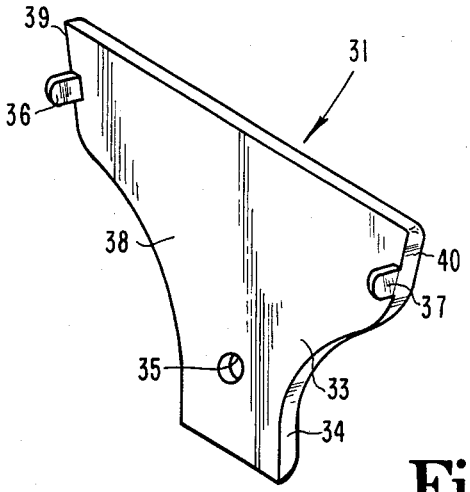
FIG. 4 is a perspective view of one of the heat shields mounted to the comb handle of FIG. 1.

The unheated hair combing teeth 13 extend lengthwise from the handle in a direction parallel to the longitudinal axis 28 of the handle. Thus, the combing teeth 13 may be moved in the direction of the longitudinal axis of the handle allowing hair to pass therebetween for combing hair. The combing hair teeth 13 include a plurality of slots 27 (FIG. 3) which extend transversely or perpendicular to the longitudinal axis 28 providing a beard combing capability. The slots in each unheated combing tooth 13 are aligned with slots provided in the adjacent hair combing tooth thereby providing a plurality of rows of aligned slots extending in a second direction transversely across teeth 13. The slots 27 are provided with sufficient depth positioning the heated teeth 14 above the bottom of each slot. Thus, as the comb is moved across a beard in a transverse direction perpendicular to axis 28, the beard will enter slots 27 thereby contacting the heated teeth 14 facilitating the grooming of the beard.

The distal end 26 of each unheated tooth 13 is beveled such as shown by surface 29 on the side of the unheated tooth opposite of slots 27. Beveled surface 29 terminates in a rounded end 30 in turn blended to the upper or slot containing edge of the unheated tooth.

A pair of heat shields 31 and 32 are fixedly mounted on opposite sides of the handle with each heat shield being spaced apart from the main body of the handle allowing air to circulate in the space 33 therebetween providing a cooling action and an insulation barrier to limit transfer of the heat from the heated teeth to the hand of the person gripping the handle.

Shield 31 will now be described, it being understood that an identical description applies to shield 32. Shield 31 includes a plastic main body 33 having an outer perimeter 34 to conform to the shape of the handle main body. An aperture 35 is provided in one end of the shield to receive a standard fastening device which extends through each shield and handle main body thereby securing the shields together. For example, a headed threaded bolt may be extended through one shield and into an internally threaded nut captively held in the opposite shield. A pair of downwardly extending legs 36 and 37 are integrally formed on the lower surface 38 of the shield along the opposite edges 39 and 40 of the shield. A groove or a pair of grooves 41 are formed in the handle main body to receive the rounded distal end of legs 36 and 37 limiting relative motion between the shield and handle main body while spacing the main body of the shield apart from the main body of the handle. Shield 32 is mounted to the opposite side of the handle thereby cooperatively with shield 31 providing a heat insulation barrier for gripping purposes.

The heated teeth are alternately positioned between the combing teeth by being transversely arranged in alternate positions on the handle. The slots in the unheated teeth have sufficient depth to allow the beard to contact the heated teeth as the beard moves through the slots. The combing teeth extend outward of the heated teeth on all sides thereof to limit contact between external objects and the heated teeth except by passing between combing teeth and except by passing through the slots.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A combination heated hair and beard comb comprising:

a handle;

a plurality of dual functioning unheated hair combing teeth cantileveredly mounted to said handle and extending lengthwise therefrom in a first direction for the first function of combing hair by moving said teeth in said first direction, said teeth including a plurality of outwardly opening slots formed laterally thereon and extending in a second direction perpendicular to said first direction in rows for a second function of combing a beard by moving said teeth in said second direction;

a plurality of heated teeth mounted to said handle and having electrical resistance means therein; and, connecting means on said handle being operable to transfer electrical energy from a source to said electrical resistance means for the heating of said heated teeth.

2. The combination comb of claim 1 wherein;

said heated teeth are alternately positioned between said combing teeth by being transversely arranged on said handle;

said combing teeth include outer teeth located outwardly of said heated teeth, each of said combing teeth extending in said first direction a greater distance than said heated teeth.

3. The combination comb of claim 1 and further comprising:

a pair of heat shields mounted on opposite sides of said handle limiting outwardly flow of heat from said heated teeth through said handle, said shields having portions spaced apart from said handle allowing air to circulate between said shields and said handle providing a cooling action and an insulation barrier.

4. The combination comb of claim 1 wherein:

said slots have closed bottom ends and open top ends with sufficient depth extending therebetween positioning said heated teeth at least partially between said bottom ends and said open top ends to allow said beard to contact said heated teeth as said beard moves through said slots, said combing teeth extend outward of said heated teeth on all sides thereof to limit contact between external objects and said heated teeth except by passing between said combing teeth and except by passing through said slots.

5. The combination comb of claim 4 wherein:

said heated teeth are alternately positioned between said combing teeth by being transversely arranged on said handle;

said combing teeth include outer teeth located outwardly of said heated teeth, each of said combing teeth extending in said first direction a greater distance than said heated teeth; and further comprising:

a pair of heat shields mounted on opposite sides of said handle limiting outwardly flow of heat from said heated teeth through said handle.

6. A heated comb comprising:

a handle;

a plurality of unheated hair combing teeth mounted to said handle and extending lengthwise therefrom in a first direction for combing hair and having slots extending through said teeth in a second direction for combing a beard;

a plurality of heated teeth mounted to said handle and having electrical resistance means therein;

connecting means on said handle being operable to transfer electrical energy from a source to said electrical resistance means for the heating of said heated teeth, and, a pair of heat shields mounted on opposite sides of said handle limiting outwardly flow of heat from said heated teeth through said handle, said shields having portions spaced apart from said handle allowing air to circulate between said shields and said handle providing a cooling action and an insulation barrier.

7. The comb of claim 6 wherein:

said heated teeth are alternately positioned between said combing teeth by being transversely arranged on said handle; and, said combing teeth include outer teeth located outwardly of said heated teeth, each of said combing teeth extending in said first direction a greater distance than said heated teeth.

8. The comb of claim 6 wherein:

said slots extend perpendicular to said first direction across each of said combing teeth and are aligned in rows to guide a board as the comb is guided across the beard in said second direction.

9. The comb of claim 8 wherein:

said heated teeth are alternately positioned between said combing teeth by being transversely arranged on said handle; and, said combing teeth include outer teeth located outwardly of said heated teeth, each of said combing teeth extending in said first direction a greater distance than said heated teeth.

10. A heated beard comb comprising:

a handle;

a plurality of unheated combing teeth mounted to said handle and extending lengthwise therefrom in a first direction to comb hair by moving said teeth in said first direction, said teeth including a plurality of slots arranged in rows formed laterally thereon and extending in a second direction for combing a beard by moving said teeth in said second direction;

a plurality of heated teeth mounted to said handle and having electrical resistance means therein; and, connecting means on said handle being operable to transfer electrical energy from a source to said electrical resistance means for the heating of said heated teeth.

11. The comb of claim 10 wherein:

said heated teeth are alternately positioned between said combing teeth by being transversely arranged on said handle, said heated teeth are sized relative to said slots to be positioned at least partially within said rows of said slots contacting a beard located in said slots; and, said combing teeth include outer teeth located outwardly of said heated teeth, each of said combing teeth extending in said first direction a greater distance than said heated teeth.

12. The comb of claim 10 and further comprising:

a pair of heat shields spaced from and mounted on opposite sides of said handle forming an air barrier limiting outwardly flow of heat from said heated teeth through said handle.

13. The comb of claim 10 wherein:

said slots extend perpendicular to said first direction across each of said combing teeth and are aligned in rows to guide a beard as the comb is guided across the beard in said second direction.

14. The comb of claim 13 wherein:

said slots have sufficient depth to allow said beard to contact said heated teeth as said bear moves through said slots, said combing teeth extend outward of said heated teeth on all sides thereof to limit contact between external objects and said heated teeth except by passing between said combing teeth and except by passing through said slots.

15. The comb of claim 14 wherein:

said heated teeth are alternately positioned between said combing teeth by being transversely arranged on said handle;

said combing teeth include outer teeth located outwardly of said heated teeth, each of said combing teeth extending in said first direction a greater distance than said heated teeth; and further comprising:

a pair of heat shields mounted on opposite sides of said handle limiting outwardly flow of heat from said heated teeth through said handle.

* * * * *

UNITED STATES PATENT AND TRADEMARK OFFICE

CERTIFICATE OF CORRECTION

PATENT NO. : 4,702,265

DATED : October 27, 1987

INVENTOR(S) : Willard T. Weddington

It is certified that error appears in the above-identified patent and that said Letters Patent is hereby corrected as shown below:

In the Abstract:
On line 1, please change the word "air" to the word --hair--.

In column 6, line 38, please change the word "bear" to the word --beard--.

Signed and Sealed this

Twelfth Day of April, 1988

*Attest:*

DONALD J. QUIGG

*Attesting Officer*

*Commissioner of Patents and Trademarks*